US005560075A

United States Patent [19]

Jankowski

[11] Patent Number: 5,560,075

[45] Date of Patent: Oct. 1, 1996

[54] WET OR DRY VACUUM WITH LOW CENTER OF GRAVITY

[76] Inventor: William C. Jankowski, P.O. Box 508, Orleans, Mass. 02653

[21] Appl. No.: 394,598

[22] Filed: Feb. 27, 1995

[51] Int. Cl.[6] ..... A47L 5/36

[52] U.S. Cl. ..... 15/327.6; 15/327.2; 15/353

[58] Field of Search ..... 15/327.2, 327.6, 15/353

[56] References Cited

U.S. PATENT DOCUMENTS

| | | | |
|---|---|---|---|
| 2,771,151 | 11/1956 | Osborn | 15/327.6 |
| 3,034,273 | 5/1962 | Wallace | 15/353 X |
| 3,286,446 | 11/1966 | Happe et al. | 55/357 |
| 3,343,199 | 9/1967 | Nolte | 15/353 X |
| 3,663,985 | 5/1972 | Burgoon | 15/353 |
| 3,720,977 | 3/1973 | Brycki | 15/353 X |
| 4,724,573 | 2/1988 | Østergaard | 15/353 X |
| 5,208,940 | 5/1993 | London et al. | 15/353 X |

*Primary Examiner*—Chris K. Moore

[57] ABSTRACT

A wet or dry tank type vacuum cleaner assembly having a low center of gravity. The electric motor and blower are mounted in a housing which is itself mounted at the base of the assembly in substantially the same horizontal plane as the base of the vacuum cleaner tank. The housing is partitioned to enclose the fan and the motor in separate chambers with provision for entrance and exit of cooling air to and from the chamber enclosing the motor and provision to exhaust air from the blower from the chamber enclosing the blower. Air is evacuated from the tank through a filter at the top of the tank and is conducted to the blower intake by a conductor assembly. The conductor assembly connects to the structure surrounding the blower intake in a manner that is air tight and liquid tight and excludes entry of liquid and debris into the blower intake.

15 Claims, 4 Drawing Sheets

WET OR DRY VACUUM WITH LOW CENTER OF GRAVITY

BACKGROUND OF THE INVENTION

1. Field of the Invention

The invention relates to tank type vacuum cleaners and more particularly to the type of vacuum cleaner that is especially adapted to use in the home, in the workshop, and in industry as a wet or dry type vacuum and the primary object of the present invention is to provide an improved device of this character.

2. Description of Prior Art

The wet or dry shop vacuums presently in the marketplace characteristically consist of on open top collection tank mounted on wheels or casters and a cover or lid in which an electric motor and blower unit are mounted. The blower unit creates a suction within the tank and debris and liquid are drawn into the tank through a vacuum hose which is connected to an inlet located in the cover of the tank or to an inlet located high on the side of the tank itself. The air being drawn from the inside of the tank and through the blower is filtered to prevent dust and debris from reaching the motor and blower unit and to prevent dust and debris-laden exhaust from being expelled into the environment in which the vacuum is being operated. While filter methods vary, the most usual is a cylindrical filter of paper, cloth, or other porous material suspended from the cover of the tank and incorporating a check ball or float arrangement which cuts off suction to the blower unit should the liquid level in the tank rise to a level at which it threatens to enter the motor and blower unit itself, a condition which could occur in vacuums which feature an inlet located in the cover and higher than the blower intake, but not likely to occur in units which feature a vacuum inlet in the side of the tank and below the level of the blower intake.

The advantages of the above described arrangements are apparent to anyone practiced in the art: (1) the blower and electric motor unit is relatively isolated from debris and especially from liquids coming into and being stored in the tank, (2) the arrangement readily lends itself to a filter and filter housing located below the motor and blower unit, attached to the cover, and containing a simple ball or float check valve, (3) the location of the vacuum inlet which connects to the vacuum hose in the cover of the assembly or at a point high up along the side of the tank makes it possible for a large amount of debris and liquid to accumulate in the tank before such accumulation reaches a level which would close off the vacuum inlet and (4) the location of the heavy operating machinery of the vacuum in and attached to the cover of the assembly makes for convenience and ease of emptying the tank inasmuch as the weight of the operating machinery is removed when the cover is removed.

The disadvantages of the above described arrangements are readily apparent to anyone who has ever actually used the wet or dry shop vacuums which are currently in the marketplace and fit the above description: (1) the location of the electric motor and blower unit at the top of the assembly creates a high center of gravity which results in extreme vertical instability for the entire assembly and (2) the location of the vacuum hose inlet in the cover at the top of the assembly or in the side of the tank a short distance down from the top of the tank causes the operator to exert substantial leverage on the inherently unstable assembly when the operator attempts to drag the vacuum forward using the vacuum hose as the tow line. When the casters or wheels on which the assembly is mounted encounter any debris or obstruction, or even such resistance as is offered by a thick pile carpet, and the operator attempts to pull the unit forward using the vacuum hose as a tow line, the combination of high center of gravity and substantial leverage resulting from the high connection point for the vacuum hose conspire to cause the vacuum cleaner assembly to capsize.

Some of the prior art attempts to deal with the problem of vertical instability by locating the motor and blower unit at the bottom of the vacuum cleaner assembly, but the prior art solutions are accompanied by disadvantages which are unacceptable and unsuited to vacuum cleaners having a wet function. U.S. Pat. No. 3,286,446 issued to Happe et al on Nov. 20, 1966 is an example of such art. With the motor and blower unit located at the bottom of the tank or canister, the Happe vacuum collects dust and debris in a dust or filter bag which is suspended above the motor/blower unit. The disadvantages of such an arrangement are several including (1) dust or filter bag arrangements are not suited to a wet vacuum use because a filter bag will not contain moisture and liquids will descend onto the electric motor and blower unit, (2) the filter area of a dust or filter bag rapidly decreases as debris accumulates in the bag and (3) dust bags are essentially messy to use and messy to empty and a dust bag of sufficient size to offer the accumulation area associated with shop vacuums would be especially messy to use and to empty. The Osborn patent, U.S. Pat. No. 2,771,151 issued Nov. 20, 1956 locates the motor and blower unit at the bottom of the assembly, in this case a canister type vacuum, and offers some solution to the problem of decreasing filter area which is caused by the accumulation of debris, but the unit is unsuited to wet/dry operation for the reasons cited above.

The extreme vertical instability of wet or dry shop vacuums now in the marketplace results from a concurrence of two conditions, (1) the high center of gravity of the vacuum assembly which is produced by locating the heavy operating machinery high in the vacuum cleaner assembly and, (2) the substantial leverage produced when the wheels or casters at the bottom of the assembly encounter obstruction or resistance and the operator attempts to move the assembly by pulling on the vacuum hose, the vacuum hose being connected at the top, or near the top, of the assembly.

The present invention is specifically directed to overcoming the first of these problems in a novel and simple manner. The second of these problems is solved in a novel and simple manner by the invention disclosed in co-pending Application entitled "Improved Vacuum Cleaner Assembly with Low Vacuum Inlet".

3. Summary of the Invention—Objects and Advantages

The principal object of the present invention is to provide a tank type shop vacuum suited to wet or dry operation in which the heavy operating machinery, specifically the electric motor and connected blower unit, are located low in the assembly so as to produce a low center of gravity and substantially enhanced vertical stability for the entire assembly.

Another object of the present invention is to house the electric motor and connected blower unit in such a manner as to protect the electric motor from liquids stored in the accumulation area of the tank and from the sometimes moisture-laden air passing through the blower unit.

Another object of the invention is to cool the electric motor with air drawn from outside the assembly as opposed to cooling the motor with the sometimes moist air being drawn from the tank and passing through the blower unit;

Another object of the invention is to evacuate air from the tank through a conventional filter, suspended in the conventional manner at the top of the tank interior and utilizing a conventional ball-type check valve and to confine and direct such air by a conductor means from the filter unit at the top of the tank to the blower at the bottom of the tank, with the conductor both air tight and liquid tight throughout its length and at all connections.

Another object of the present invention is to accomplish the above described objects in a manner that is unique, simple, and which lends itself to relative ease of assembly and to production costs which are competitive with other wet or dry shop vacuums now in the marketplace. Further objects and advantages of the invention will become apparent from a consideration of the drawings and ensuing description

DETAILED DESCRIPTION OF THE PREFERRED EMBODIMENT

Figure 1:
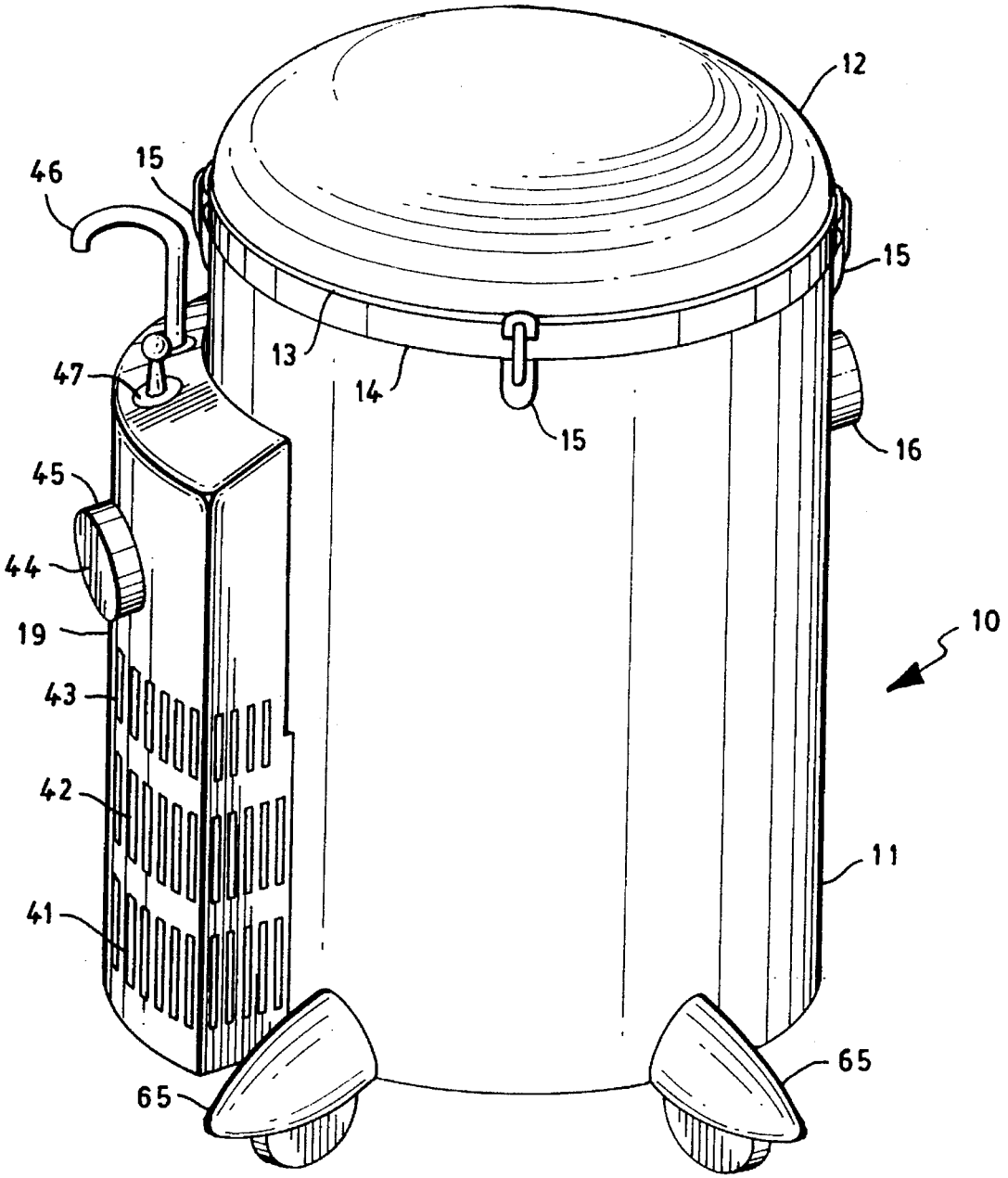
FIG. 1 is a perspective view of a tank type vacuum cleaner with blower and motor housing according to the present invention incorporated therein.
Figure 2:
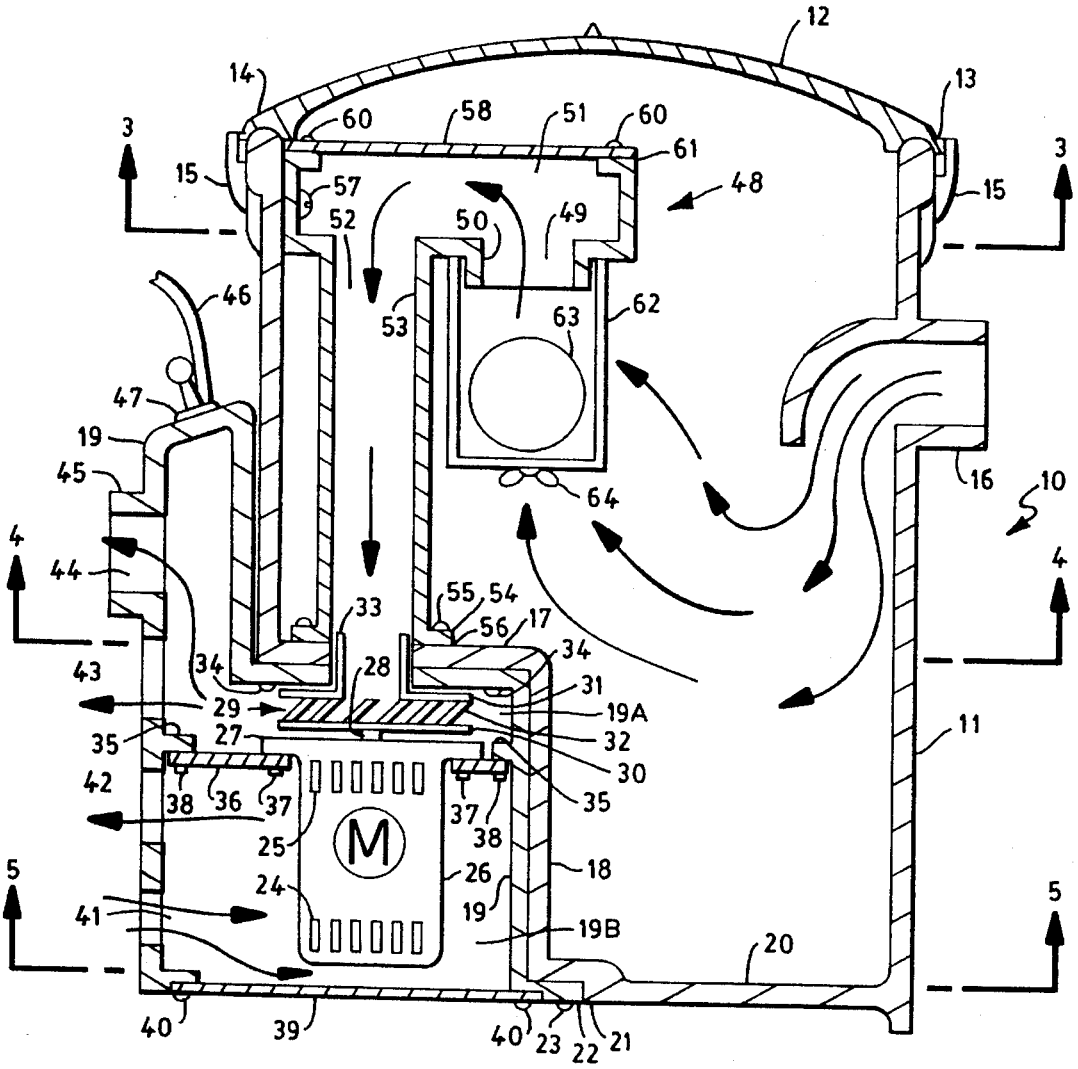
FIG. 2 is a cross sectional view taken substantially along line 2—2 of FIG. 3.
Figure 3:
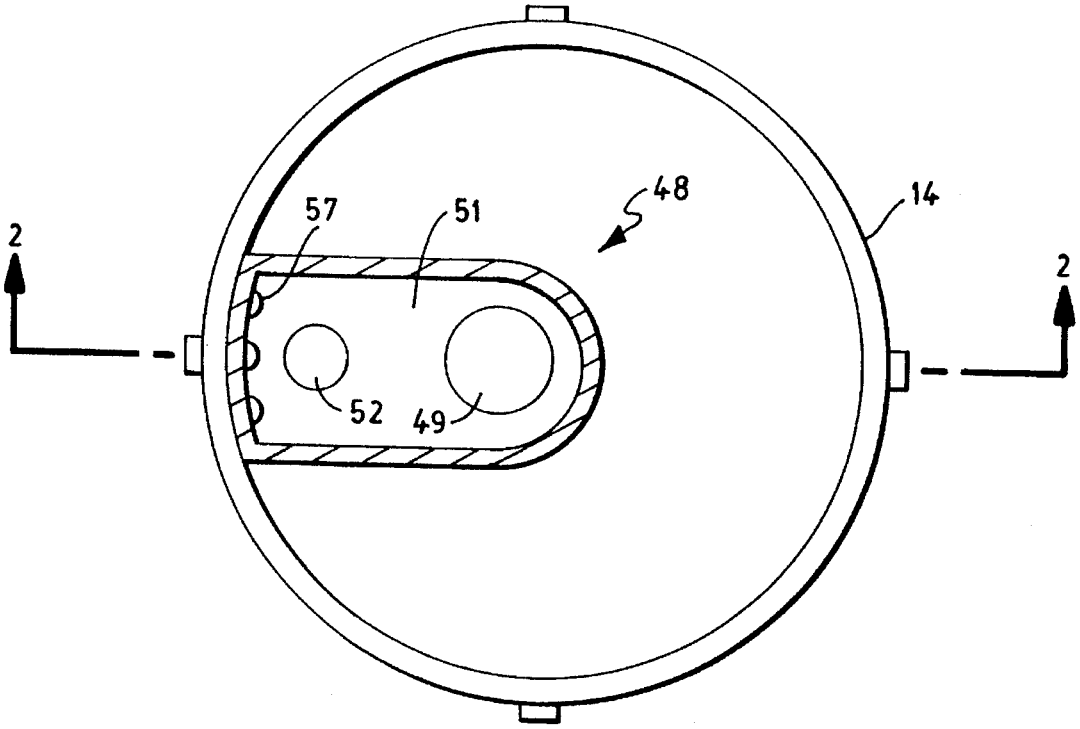
FIG. 3 is a cross sectional view taken substantially along line 3—3 of FIG. 2.

Referring now to the accompanying drawings wherein like reference numerals denote the same parts throughout the various views, there is disclosed in FIG. 1 and FIG. 2 a tank type vacuum cleaner, generally designated as 10, comprising a generally cylindrical open topped plastic drum or tank 11 defining an accumulation area, a cover 12 having a curved annular flange 13 which cooperates with the rolled upper edge 14 of tank 11. Cover 12 is held to tank 11 by a plurality of releasable fasteners 15. The tank and the cover are comprised of plastic and are manufactured by molding A vacuum inlet 16 which is adapted to connect with a conventional flexible vacuum cleaner hose (not shown) is provided in the wall of the tank 11 below the rolled upper edge 14 of the tank 11 as seen in FIG. 1 and FIG. 2. Opposite vacuum inlet 16 and at the bottom of tank 11, the generally cylindrical shape of tank 11 is interrupted by a void molded into tank 11 and formed by a substantially horizontal wall 17 and a substantially vertical wall 18. The void formed by wall 17 and wall 18 conforms to and cooperates with the exterior surfaces of that portion blower and motor housing 19 which intrudes within the space defined by the floor 20 of tank 11 and the outside circumference of tank 11. The thickness of floor 20 is increased at the juncture where floor 20 meets vertical wall 18, such increased thickness being sufficient to permit a recess 21 in floor 20 of sufficient depth to receive flange 22 on blower and motor housing 19 and of sufficient depth to receive a plurality of screws 23 which connect blower and motor housing 19 to floor 20 as best seen in FIG. 2.

An electric motor, represented in FIG. 2 by an encircled "M" is mounted as shown in FIG. 2. Motor "M" is a conventional electric blower motor such as is customarily used in shop vacuums, containing its own internal cooling fan (not shown), intake ports 24 to admit cooling air to the internal cooling fan and exhaust ports 25 to permit exit of cooling air from motor housing 26. An annular flange 27 is molded onto and is an integral part of motor housing 26 and encircles motor housing 26 at the end from which shaft 28 emerges from motor "M" as seen in FIG. 2.

A blower unit, designated generally as 29, comprising parallel concentric discs, lower disc 30, upper disc 31, and blower blades 32 contained between disc 30 and disc 31, is mounted on shaft 28. A concentric opening in disc 31 surrounded by annular wall 33 furnishes intake air to blades 32 of blower unit 29.

Figure 4:
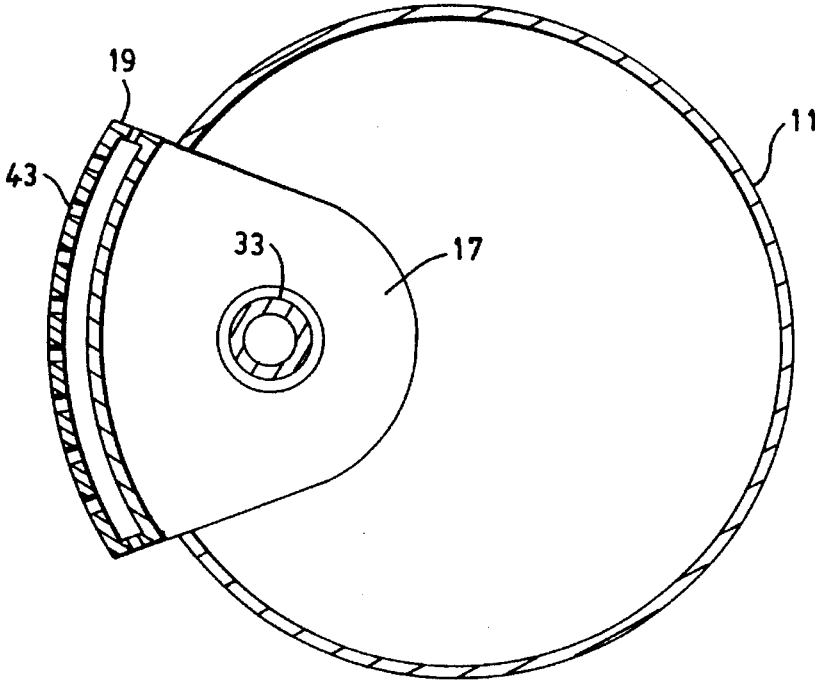
FIG. 4 is a cross sectional view taken substantially along line 4—4 of FIG. 2.
Figure 5:
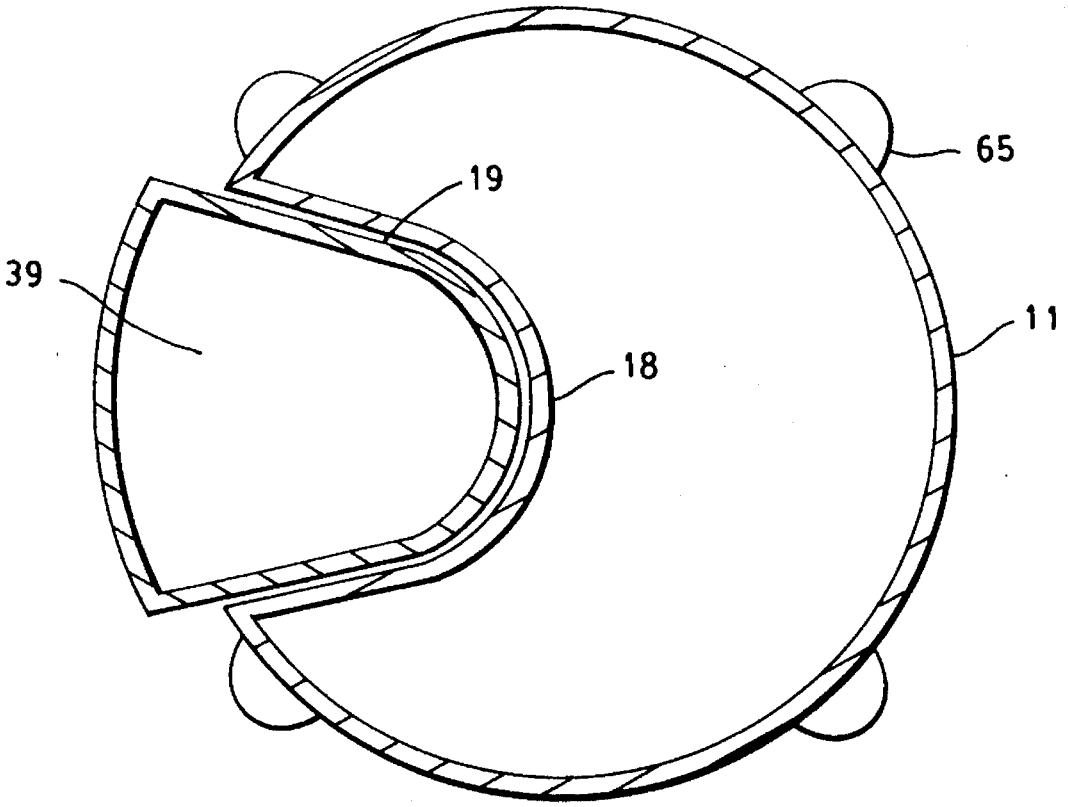
FIG. 5 is a cross sectional view taken substantially along line 5—5 of FIG. 2.

The general shape of blower and motor housing 19 is best seen in the sectional view in FIG. 2 and the sectional plan views in FIG. 4 and FIG. 5. Blower and motor housing 19 connect to floor 20 of tank 11 at flange 22 by screw fasteners 23 and to horizontal wall 17 by screw fasteners 34. All screw fastenings used to connect blower and motor housing 19 to tank 11 and fastenings used to mount motor "M" in blower and motor housing 19 and to close off the bottom of blower and motor housing 19 are installed from the underside of housing 19 and are easily accessible when installed sequentially. "Housing 19 is installed with the center of curvature of its outer curved wall being generally coaxial with the longitudinal axis of the tank."

Flange 35 follows and conforms to the interior of blower and motor housing 19 at the elevation shown in FIG. 2. A horizontal partition 36 with a circular opening of sufficient size to receive electric motor housing 26 connects to flange 27 by screw fasteners 37 and connects to flange 35 by screw fasteners 38. Annular wall 33 projects through an annular opening in blower and motor housing 19 and horizontal wall 17, which circular openings coincide with each with the other. Annular wall 33 projects through the coinciding circular openings a predetermined distance and annular wall 33 clears surrounding structure with a predetermined tolerance. The bottom of blower and motor housing 19 is closed by cover 39 attached by screw fasteners 40. Cover 39 and horizontal partition 36 create within blower and motor housing 19 an upper chamber 19A and a lower chamber 19B.

Blower and motor housing 19 extends beyond the outside circumference of tank 11 and rises above the level of horizontal wall 17 as seen in FIG. 2, FIG. 4 and FIG. 5. Intake ports 41 in lower chamber 19B furnish external cooling air to intake ports 24 in motor housing 26. Exhaust ports 42 provide exit for warm exhaust air coming from exhaust ports 25.

Exhaust air from blower unit 29 leaves upper chamber 19A through exhaust ports 43 and through a circular opening 44 defined by an annular wall 45 to which a conventional flexible vacuum hose (not shown) may be connected for blower function. An electric supply cord 46 and switch 47 is mounted on blower and motor housing 19 as shown in FIG. 2 and electric power is furnished to motor "M" by insulated cord passing through horizontal partition 36 (electrical connection not shown).

Intake air supply for blower unit 29 is conducted to blower intake at annular wall 33 by a conductor assembly generally designated as 48. Conductor chamber 51 of conductor assembly 48 attaches to the rim of tank 11 by screw fasteners 57 and is closed by a cover 58 which attaches to conductor chamber 51 by screw fasteners 60. Air tight integrity is ensured between cooperating surfaces by resilient gasket 61. Suspended below circular opening 49 in conductor chamber 51 is a conventional inverted filter (not shown), filter frame 62, and a conventional internal ball type check valve 63 which seats against annular wall 50. A conventional porous filter (not shown) slips over filter frame 62 and is held in place by wing nut 64. Filtered air is drawn from inside filter frame 62, up through circular opening 49 and into conductor chamber 51. From conductor chamber 51 it descends through circular opening 52 and is conducted by annular wall 53 down to blower intake at annular wall 33. Flange 54 on annular wall 53 connects by screw fasteners to horizontal wall 17. Resilient gasket 56 ensures air tight and liquid tight integrity between cooperating surfaces.

Caster mounts 65 as seen in FIG. 5 attach to the bottom circumference of tank 11 and casters (not shown) provide mobility for the vacuum cleaner assembly.

Numerous variations and modifications of the structure herein disclosed will suggest themselves to those skilled in the art. The preferred embodiment of the disclosed invention utilizes a rigid conductor assembly likely to endure both use and abuse. With little adaptation, intake air can be conducted from a filter located at the top of the assembly to the blower intake at the bottom of the assembly through a flexible vacuum hose connected to short annular walls top and bottom by means of conventional hose clamps: a less expensive conductor means, but questionable as to long term durability.

The preferred embodiment discloses a blower and motor unit mounted in a blower and motor housing, with the blower and motor housing screw fastened in the void in the tank. The blower and motor housing with the blower and motor mounted within can be mounted on a base which is separate from the tank, on which base the casters are mounted, which base connects to the tank by means of releasable fasteners with the blower and motor housing joining the conductor system of the tank by means of a neoprene gasket which compresses when the tank is snapped down onto the base. The advantage of such an arrangement is that the tank can be emptied without lifting the weight of the motor and blower unit, the disadvantage being that the more elaborate assembly results in increased manufacturing cost.

In the disclosed invention a substantial part of the blower and motor housing nestles into and cooperates with the surfaces of a void molded into the tank, the void in the tank diminishing the volume of the accumulation area of the tank. The blower and motor housing can by mounted in the same horizontal plane, but on the exterior wall of the tank with a simple exterior conductor supplying air from the filter unit to the intake opening in the blower and motor housing. Aside from giving the assembly an awkward shape, moving the weight of the electric motor outside the outer circumference of the tank sacrifices some of the stability gained by moving the weight of the motor and blower to the base of the assembly.

In the disclosed invention the base of the electric motor is located in substantially the same horizontal plane as the caster mounts, a feature which produces a center of gravity for the entire vacuum cleaner assembly which is substantially lower than the center of gravity of units in the marketplace which feature motor and blower assembly in the cover of the vacuum cleaner assembly. Exact center of gravity calculations for the disclosed invention will vary depending upon circumference of tank, distance between caster mounts, height of tank, and weight of motor. The low center of gravity produced by the disclosed invention provides greatly enhanced vertical stability for the vacuum cleaner assembly and maximum advantage is taken of the low center of gravity when the disclosed invention is used in combination with the low vacuum inlet disclosed in co-pending Application entitled "Improved Vacuum Cleaner Assembly with Low Vacuum Inlet".

While other variations and modifications may suggest themselves, it is to be understood that the present disclosure relates to a preferred embodiment of the invention which is for purposes of illustration only and is not to be construed as a limitation of the invention. All such modifications which do not depart from the spirit of the invention are intended to be within the scope of the appended claims.

I claim:

1. In a vacuum cleaner of the wet or dry type, an improved vacuum cleaner assembly comprising a tank generally cylindrical in shape which defines an accumulation area, a removable cover for sealing said tank, a means for removably attaching said cover to the tank, a plurality of casters and caster mounts attached to the lower circumference of the tank, a means for evacuating air from the tank, a porous filter mounted at the top of the tank in substantially the horizontal plane defined by the upper rim of the tank, a vacuum inlet in the wall of the tank to admit matter into the accumulation area of the tank and an outlet to exhaust air evacuated from the tank, the improvement comprising, combination:

a housing defining a cavity to accept an electric motor and a blower, said housing being mounted generally coaxially with said tank, with the base of the housing mounted in substantially the same horizontal plane as the base of the tank, the housing having an opening to admit intake air to said blower and exhaust ports and a blower hole to receive and eliminate exhaust air from the blower;

a conductor means confining and directing the flow of filtered air from the porous filter mounted at the top of the tank in substantially the horizontal plane defined by the upper rim of the tank to the opening admitting intake air to the blower in the housing at the base of the tank;

whereby air entering the tank through a vacuum inlet in the wall of the tank and passing through a porous filter mounted at the top of the tank is conducted through the tank outlet to the blower intake in the housing at the base of the tank and is from there exhausted through the blower hole and exhaust ports; the concentration of the weight of the electric motor and the blower in the housing at the base of the assembly producing a low center of gravity and substantially enhanced vertical stability for the vacuum cleaner assembly.

2. The improved vacuum cleaner assembly of claim 1 wherein said tank and housing are comprised of molded plastic.

3. The improved vacuum cleaner assembly of claim 1 wherein a horizontal partition divides the interior of said housing into an upper chamber and a lower chamber, said lower chamber enclosing the electric motor with the shaft of the electric motor projecting through said horizontal partition into said upper chamber, the lower chamber having intake and exhaust ports providing ventilation to the electric motor, the upper chamber enclosing the blower, the blower mounted on the shaft of the motor, the upper chamber having exhaust ports and a blower hole to eliminate blower exhaust from the upper chamber, the upper chamber having an opening admitting intake air to the blower.

4. The improved vacuum cleaner assembly of claim 3 wherein said blower is comprised of concentric vanes enclosed between parallel concentric discs, the top disc having a concentric opening admitting intake air to said concentric vanes, said concentric opening being defined by an annular wall rising from the disc a predetermined distance.

5. The improved vacuum cleaner assembly of claim 4 wherein said wall rises from the top disc through the concentric openings of the housing and the molded void into the conductor means a predetermined distance while clearing the surrounding structure with a predetermined tolerance.

6. The improved vacuum cleaner assembly of claim 1 wherein the generally cylindrical shape of the tank is interrupted by a molded void which intrudes within the outer circumference of the tank at the base of the tank, the exterior surfaces of said molded void generally conforming to and cooperating with the exterior surfaces of so much of the blower and motor housing as intrudes within the outer circumference of the tank.

7. The improved vacuum cleaner assembly of claim 6 wherein said housing attaches by a flange and screw fastening means to the tank with the base of said housing in substantially the same horizontal plane as the base of the tank and with the exterior surfaces of so much of the housing as encloses the motor and blower in cooperation with the exterior surfaces of the molded void.

8. The improved vacuum cleaner assembly of claim 6 wherein a circular opening in said molded void coincides with the circular opening in the motor and blower housing admitting intake air to the blower.

9. The improved vacuum cleaner assembly of claim 8 wherein a conductor means confining and directing the flow of air evacuated from said tank from a filter located at the top of the tank to the circular opening in said void connects to and seals to the structure surrounding said molded void by screw fastening and gasket sealing means.

10. In a vacuum cleaner of the wet or dry type, an improved vacuum cleaner assembly comprising a tank which defines an accumulation area, a removable cover for sealing said tank, a means for removably attaching said cover to said tank, a plurality of casters and caster mounts attached to the lower circumference of the tank, a means for evacuating air from the tank, a means for filtering dust and debris from the air evacuated from the tank, a vacuum inlet to admit matter into the accumulation area of the tank and an outlet to exhaust air evacuated from the tank, the improvement comprising, in combination:

a housing defining a cavity to accept an electric motor and a blower, said housing being mounted generally coaxially with said tank with the base of the housing in substantially the same horizontal plane as the base of the tank, the housing being divided by a horizontal partition creating within the housing an upper chamber and a lower chamber, said electric motor being mounted on the underside of said horizontal partition with the shaft of the motor projecting into said upper chamber, said lower chamber having intake and exhaust ports for supplying and exhausting cooling air to and from the motor, the motor having its own internal cooling fan; said upper chamber enclosing said blower, the blower being mounted on the shaft of the motor, the blower comprising concentric vanes enclosed between parallel concentric discs, the top concentric disc having a concentric circular opening admitting intake air to the vanes of the blower, said circular opening being defined by an annular wall rising a predetermined distance above the circular opening; said upper chamber having exhaust ports and having a blower hole suited to connection to a flexible external vacuum hose for discharge of exhaust air from the blower; the upper chamber having a circular opening through which the annular wall rising from the top concentric disc of the blower projects a predetermined distance and clears the surrounding circular opening with a predetermined tolerance;

a conductor means confining and directing the flow of filtered intake air for the blower from a filter mounted in substantially the same horizontal plane as the upper rim of the tank through the tank outlet to the circular opening in the upper chamber of the housing.

11. The improved vacuum cleaner assembly of claim 10 wherein said tank and housing are comprised of molded plastic.

12. The improved vacuum cleaner assembly of claim 12 wherein said tank is of generally cylindrical shape with a molded void interrupting the cylindrical configuration of the tank at the base of the tank, the exterior surfaces of said void generally conforming to and cooperating with the exterior surfaces of that part of the blower and motor housing that encloses the blower and the motor.

13. The improved vacuum cleaner assembly of claim 12 wherein a circular opening in said molded void coincides with the circular opening in the upper chamber of the blower and motor housing when the exterior surfaces of the void are conforming to and in cooperation with the exterior surfaces of the housing.

14. The improved vacuum cleaner assembly of claim 12 wherein a conductor means confines and directs the flow of filtered air from a filter at the top of the tank to the circular opening in said molded void at the bottom of the tank and connects and seals to the circular opening in the molded void by screw fastening and gasket sealing means, whereby liquid and debris stored in the accumulation area of the tank are excluded from entry into the circular entry and from entry into the blower intake.

15. The improved vacuum cleaner assembly of claim 10 wherein said housing connects to said tank by screw fastening means with the annular wall rising from the circular opening in the top disc of the blower passing through the concentric circular openings in the housing and the molded void, the annular wall clearing the surrounding structure with a predetermined tolerance and rising a predetermined distance.

* * * * *